US007108101B1

(12) United States Patent
Westhoff et al.

(10) Patent No.: US 7,108,101 B1
(45) Date of Patent: Sep. 19, 2006

(54) MANHOLE INSERT FOR MANUFACTURE OF A CAST MEMBER AND TO PROVIDE A STEP INSERT HAVING INCREASED STRUCTURAL AND HOLDING STRENGTH

(75) Inventors: James A. Westhoff, Langhorne, PA (US); James A. Kelly, Upper Black Eddy, PA (US); Craig B. Williams, Fayetteville, GA (US)

(73) Assignee: Poly-Tec Products, Inc., Tullytown, PA (US)

( * ) Notice: Subject to any disclaimer, the term of this patent is extended or adjusted under 35 U.S.C. 154(b) by 1124 days.

(21) Appl. No.: 09/395,106

(22) Filed: Sep. 14, 1999

Related U.S. Application Data

(60) Provisional application No. 60/100,234, filed on Sep. 14, 1998.

(51) Int. Cl.
*E06C 9/02* (2006.01)
*E06C 9/04* (2006.01)

(52) U.S. Cl. ..... 182/90; 182/92; 249/214; 249/216; 52/699; 52/698; 52/701; 52/704; 411/510; 411/172; 411/82

(58) Field of Classification Search ..... 52/689, 52/695, 701, 700, 703, 704, 705; 249/177, 249/37, 38, 41, 43, 214, 216; 182/90, 92; 135/146, 140, 142; 411/511, 510, 508, 509, 411/512, 172, 82, 82.1; 403/12, 13
See application file for complete search history.

(56) References Cited

U.S. PATENT DOCUMENTS

| | | | | | |
|---|---|---|---|---|---|
| 1,108,859 | A | * | 8/1914 | Bennett | 52/698 |
| 1,185,765 | A | * | 6/1916 | Brooks | 52/698 |
| 1,373,645 | A | * | 4/1921 | Bandoly | 411/511 |
| 3,200,903 | A | * | 8/1965 | Marino | 52/699 |
| 3,740,083 | A | * | 6/1973 | Zenhausern | 287/20.3 |
| 3,974,615 | A | | 8/1976 | Ditcher | |
| 4,100,997 | A | | 7/1978 | Peacock | |
| 4,117,643 | A | * | 10/1978 | Lamothe | 52/699 |
| 4,195,709 | A | | 4/1980 | Gianotti et al. | |
| 4,241,543 | A | | 12/1980 | Foscarini et al. | |
| 4,365,780 | A | | 12/1982 | Williams | |
| 4,534,225 | A | | 8/1985 | Peacock | |
| 4,610,330 | A | * | 9/1986 | Borst | 182/90 |
| 4,655,318 | A | * | 4/1987 | Bowen | 182/90 |
| 4,771,861 | A | * | 9/1988 | Zenhausern et al. | 182/46 |
| 4,978,265 | A | * | 12/1990 | Dewan | 411/60 |

(Continued)

FOREIGN PATENT DOCUMENTS

| | | | | |
|---|---|---|---|---|
| AT | 2606498 | * | 9/1976 | 411/511 |

(Continued)

*Primary Examiner*—Lanna Mai
*Assistant Examiner*—Phi Dieu Tran A

(57) ABSTRACT

Method and apparatus for forming cast members. Steps are provided in the cast member by sliding mounting flanges of hollow plastic step inserts into slots provided in the inner mold shell. The cast material is then poured into the mold. Once the cast material has set, the cast member is withdrawn from the mold assembly. The step insert mounting flanges are broken away, leaving hollow step inserts into which manhole steps are force-fittingly mounted. The inserts are provided with integral cover tabs which cover larger slots provided to facilitate insertion of the step inserts, preventing leakage of the cast material into the mold assembly. Integral cover tabs are similarly provided on enforcement ring support members mounted in a similar fashion to insertion slots provided on one of the mold members to cover larger width slot portions to prevent seepage of cast material. Similar seals are provided by cylindrical-shaped inserts for use in wetcast and drycast fabrication methods.

15 Claims, 9 Drawing Sheets

U.S. PATENT DOCUMENTS

| | | | | | |
|---|---|---|---|---|---|
| 5,277,272 | A | | 1/1994 | Williams et al. | |
| 5,647,713 | A | * | 7/1997 | Ge et al. | 411/509 |
| 5,653,078 | A | * | 8/1997 | Kies et al. | 52/698 |
| 5,913,792 | A | * | 6/1999 | Fischer | 52/698 |
| 5,932,255 | A | * | 8/1999 | Ditcher et al. | 425/121 |
| 5,934,821 | A | * | 8/1999 | Shaw et al. | 404/62 |
| 5,941,045 | A | * | 8/1999 | Plehanoff et al. | 52/704 |
| 5,967,256 | A | * | 10/1999 | Takahashi | 182/92 |
| 6,068,083 | A | * | 5/2000 | Takahashi | 182/92 |
| 6,082,383 | A | * | 7/2000 | Wilson | 135/41 |
| 6,200,059 | B1 | * | 3/2001 | Sawdon et al. | 403/13 |
| 6,315,077 | B1 | | 11/2001 | Peacock et al. | |
| 6,336,766 | B1 | * | 1/2002 | Devillele | 403/348 |

FOREIGN PATENT DOCUMENTS

| | | | | |
|---|---|---|---|---|
| AT | 173227 | * | 3/1986 | 182/90 |
| GB | 0520169 | * | 4/1940 | 411/510 |

* cited by examiner

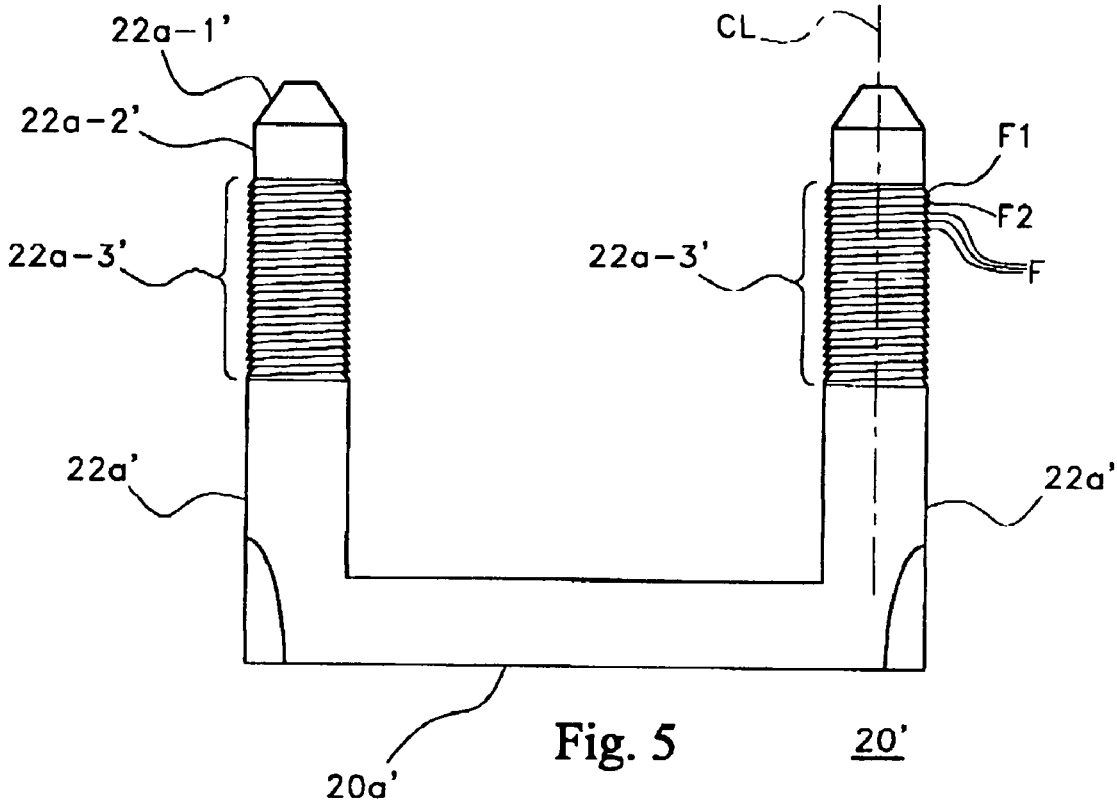
Fig. 5
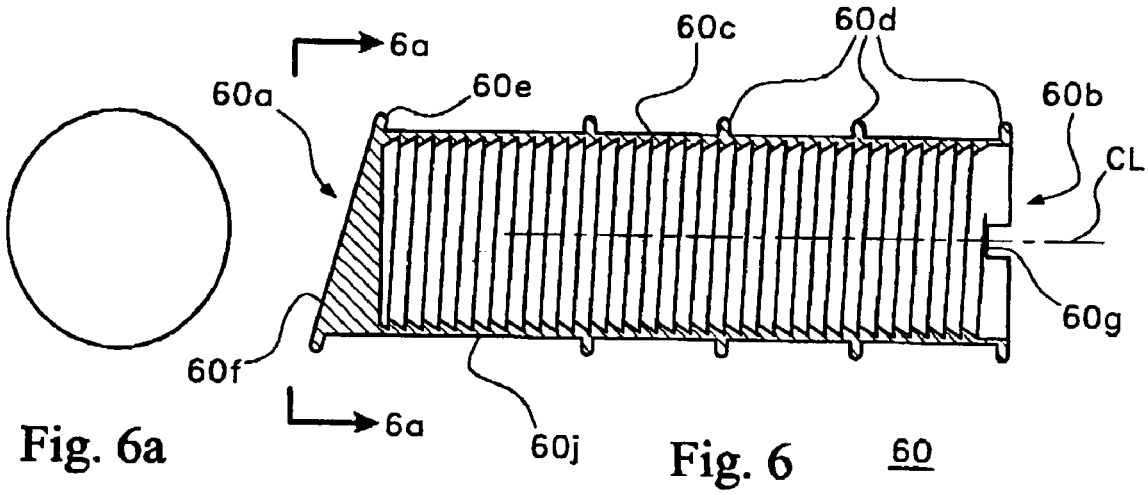
Fig. 6a
Fig. 6

MANHOLE INSERT FOR MANUFACTURE OF A CAST MEMBER AND TO PROVIDE A STEP INSERT HAVING INCREASED STRUCTURAL AND HOLDING STRENGTH

CROSS REFERENCE TO RELATED APPLICATIONS

This application claims priority from Application No. 60/100,234; filed on Sep. 14, 1998 which application is incorporated herein by reference.

FIELD OF THE INVENTION

The present invention relates to method and apparatus for producing cast concrete members and the like and more particularly to a method and apparatus for producing cast members in which members utilized to form step inserts and/or to support reinforcement members are provided with means to prevent undesirable seepage of the cast material and thereby retain the cast material into the mold assemblies within the mold assembly as the cast material sets.

BACKGROUND OF THE INVENTION

It is well known in the art to provide manhole assemblies with steps to facilitate a descent into and ascent from the manhole assembly through the top opening thereof.

One of the preferred techniques is described, for example, in U.S. Pat. No. 3,974,615 issued Aug. 17, 1976, assigned to the assignee of the present invention, which patent teaches the use of hollow plastic manhole step inserts releasably mounted to an inner mold member of a mold assembly. The cast material is poured into the mold assembly and when set, the cast member is withdrawn from the mold assembly. Mounting flanges provided at the open end of the manhole step inserts are arranged to break away from the main body portion of the manhole step insert when the cast member is lifted out of the mold assembly, leaving the manhole step inserts imbedded in the cast material. A pair of such inserts is adapted to receive the free ends of a substantially U-shaped step member, which free ends are force-fitted into the hollow manhole step inserts forming an excellent force fit there between.

The aforementioned U.S. Pat. No. 3,974,615 teaches manhole step inserts having two pairs of flanges arranged at right angles relative to one another. One pair of flanges engages an internal surface of the inner mold member while the other pair of flanges is bent inwardly to pass through a substantially rectangular-shaped opening in the inner mold shell so that the two pairs of flanges cooperate to embrace the inner mold shell therebetween to maintain the manhole step insert in proper position preparatory to pouring the cast material into the mold assembly.

In order to simplify the mounting of the manhole step insert to the inner mold shell and in order to avoid the need for flexing the pair of flanges which are passed through the rectangular shaped opening and which may prematurely break due to said flexing, a design has been developed in which a pair of insertion slots are precision cut into a blank member which is inserted into an opening in the inner mold shell and preferably welded thereto.

FIG. 1*a* shows a conventional arrangement in which the step insert 10*a* shown in FIGS. 1*b*, and 1*c* comprises a hollow housing having a closed end 10*a*, four (4) elongated sides 10*b* through 10*e* and an open end 10*f*. A pair of flanges 10*g* and 10*h* are integrally joined to the right-hand ends of sides 10*b* and 10*d*. A second pair of flanges 10*j* and 10*k* are integrally joined to the right-hand ends of sides 10*c* and 10*e*. Flanges 10*j* and 10*k* extend further to the right than flanges 10*g* and 10*h* before bending outwardly.

Rectangular-shaped openings are cut into the inner mold shell 12. One such rectangular shaped opening 12*a* receives a blank 14 fitted into opening 12*a* and preferably fixedly secured thereto such as by welding. A pair of slots 15, 16 are precision cut into blank 14 so that the left-hand ends 15*b*, 16*b* of slots 15 and 16 have a width greater than the right hand ends 15*a*, 16*a* of slots 15 and 16.

The increased width of slot portions 15*b* and 16*b* is chosen to be sufficient to permit insertion of the flanges 10*j*, 10*k* therethrough. The manner of insertion is such that the step insert 10 is aligned so that the flanges 10*j*, 10*k* are moved into alignment with the slot portion 15*b*, 16*b*. The step insert 10 is then moved in the direction shown by arrow A to press tabs 10*j*, 10*k* through slots 15*b*, 16*b* so that they are clear of the slots and extend slightly beyond the concave surface of inner mold shell 12. At this time, the step insert is moved to the right so that the projecting portions 10*j*-1, 10*k*-1, are fitted in the narrow slots 15*a*, 16*a* and flanges 10*j*, 10*k* rest against the concave surface of inner mold shell 12 extending respectfully upwardly and downwardly from narrow slot portion 15*a*, 16*a*. Flanges 10*g* and 10*h* rest against the convex surface of the blank 14.

Cast material is poured between the inner and outer mold shells 12, 18. When the cast material (typically concrete) is set, the cast member is removed from the mold assembly, typically by lifting the cast member vertically upward. The flanges 10*j*, 10*k* break away from the main body of the step insert 10. FIG. 1*c* shows the jagged edges E where the flanges 10*j*, 10*k* have broken away from the main body portion 10. Either a substantially U-shaped aluminum step 20 or plastic polypropylene step 22 is inserted into the step inserts by movement of the free arms 20*a*, 22*a* which are pressed or driven into an interference fit within the hollow interior of the step inserts (only half of each of the aluminum (20) and plastic polypropylene (22) step is shown in FIG. 1*c* for purposes of simplicity.

The insert 10 is preferably made of polypropylene which has a life expectancy exceeding concrete itself and further exhibits excellent chemical resistance. The inserts 10 tend to serve as a protective shield against dissimilar material reaction such as an electrolysis of aluminum and concrete. The insert meets requirements of all ASTM C-478 § 12 and Performance Test Procedures of ASTM C-497.

The insert 10 design shown in FIGS. 1*a*–1*c* has a disadvantage that seepage occurs through the larger width slots 15*b*, 16*b* provided in the blank 14 while the concrete is being poured into the mold assembly. More specifically, fines were found to seep through the wider slot areas 15*b*, 16*b* and enter into the mechanical hinge work provided for release of the cast member. Additional problems occurred when the cured concrete parts stripped out of forms were found to exhibit a honeycomb structure in the region where the fines bled through.

A number of conventional step members utilized in manhole assemblies and the like have been provided with substantially rectangular and in most cases square-shaped, cross-sectional shapes, as can be seen in FIG. 1*c*. Other step members adapted for insertion into the step inserts are designed to have circular cross-sections. In addition, as can be seen from FIG. 5*a*, a major portion of the insertable portion of each leg of the step is provided with a generally saw-tooth-shaped configuration wherein the saw-tooth configuration is of such a nature as to facilitate insertion of the legs to the step into each step insert while providing a frictional fit of significantly increased gripping force which acts against a force acting in the direction to withdraw the step legs from the insert.

The steps of circular cross-section thus require a step insert of a design and shape which conforms with and cooperates with the design and shape of the steps whose legs are adapted to be inserted therein.

Manhole assemblies are typically produced through either a drycast or a wetcast method, both of which methods are well known in the art.

Utilizing one conventional drycast method, the granulated casting material is placed into the mold assembly which is vibrated and packed down to assure that the dry casting material is evenly and densely packed within the mold assembly. When the casting material has been filled to the appropriate level within the mold assembly and appropriately compacted, the core portion of the mold extends a pair of reciprocating pins, which are operated by hydraulic means, into the casting material to form openings within the cast material of a size appropriate for receiving the legs of a step. In the conventional technique, the tremendous pressures developed within the casting material cause these openings to "sag" or become "off-round" when the pins are removed and the openings often accumulate some of the cast material when the cast member is removed from the mold assembly which necessitates the operators employing a drill or other device to reopen or "reround" the openings to enable the legs of a step to be inserted therein.

The hydraulically-operated pins which create the step openings typically extend from a core mold member which has a curved, convex outer periphery. The casting material entering into the openings in the region between the pins and the opening in the core member through which the pins extend, serves to render the pins inoperative and possibly even causing damage to the mechanism. At the minimum, the entry of fines into the mechanism require regular maintenance to maintain the mechanism in operating condition, which disadvantages are to be avoided.

In the employment of the wetcast method, there has heretofore been no step insert available which is inserted into the casting material by hydraulically operated pins.

BRIEF DESCRIPTION OF THE INVENTION

The present invention, in one embodiment, is characterized by comprising a step insert design for use with steps having insertable portions of rectangular cross section and which overcomes the seepage problems through the provision of integral cover tabs provided on at least one of the supporting flanges for substantially covering and sealing the larger slot portions when the insert is properly mounted within the precision cut slots to protect against seepage. The cover tabs may be utilized on other mounting members to prevent the aforementioned seepage. For example, the supports used for supporting wire reinforcements embedded in the cast member are similarly provided with mounting flanges from for slidable insertion into precision cut slots within blanks provided therefore. The support is provided with cover tabs for covering the slots of greater width to prevent seepage of cast material there-through when the cooperating flanges of the support are properly seated within the precision cut slots.

The present invention further comprises a step insert design for use with steps having circular-shaped insertion portions, said insert having a substantially circular cross-section and being provided with an open end and closed end. The closed end has a substantially flat surface which forms an angle with the longitudinal axis of the step insert which aligns with the opening in the curved convex surface of the mold assembly core member. The insert is designed to fit over a free end of a circular-shaped, hydraulically operated pin and is provided with at least one alignment slot which cooperates with an alignment projection provided along a shoulder of the pin to assure proper angular orientation of the insert closed end on the insertion pin.

The insert is mounted upon the pin and, when properly positioned, has its end cap substantially flush with the convex surface of the mold assembly core member and has an outer diameter which is just slightly less than the inner diameter of the opening which it substantially seals, to prevent seepage of fines into the mold assembly mechanism.

The outer periphery of the insert is provided with a plurality of outwardly radially extending annular flanges therealong which serve to significantly enhance the holding power of the dry cast concrete upon the insert.

The closed end of the insert is increased in thickness as compared with the remainder of the insert to significantly enhance the structural strength of the insert as it is pushed into the drycast material.

The interior periphery of the insert is provided with annular serrations of a "one way" type in that the tapered, annular projections are diagonally aligned along one surface thereof so as to make it easier to insert the leg portion of a step while the opposite surface is substantially perpendicular to the longitudinal axis of the insert, thereby significantly increasing the frictional fit between the leg portion and the insert to act against forces working in the direction of removal of a leg of a step out of the insert.

The sloping, closed end wall of the insert, in addition to substantially sealing the opening in the core member, lies a substantially uniform distance from the outer convex periphery of the cast member so is not to alter, affect or disturb the structural strength of the cast member.

One insert utilized in the fabrication of the cast members using the wetcast method has a open end and a closed end. The open end lies in a plane which forms an angle with a longitudinal axis of the insert and is provided with a flange adapted to rest against an opening in the mold assembly core member. A plurality of flexible, hook-like ears or projections extend away from the diagonally aligned flange and are arranged, preferably at equiangular-spaced intervals about the insert so as to make a snap-fit with a marginal portion of the opening to hold the insert into position preparatory to in filling of the mold assembly with the wetcast material. The flange seals the opening to prevent fines from entering into the mold assembly mechanism.

The ears are designed to snap off due to a shearing force applied thereto as the cast member, after having been set, is pulled away from the form. Heretofore, inserts utilized in the wetcast method for providing inserts for circular-shaped step members employ a pin which is inserted into the mold assembly during casting. The pin is then removed from the cast member after it has set and is removed from the form. This technique requires an undesirable additional manufacturing step and further fails to provide an opening for the leg of the step which has the supporting strength and holding force of the insert of the present invention.

Another preferred insert embodiment for use in the wetcast method is comprised of an assembly of first and second hollow, cylindrical molded plastic members. A first member has a diagonally aligned flange intermediate its open ends and has axially aligned slots on opposite sides of the flange. A bead provided on one end of the first member slides into a step tube welded to a mold core member and aligned with an opening in the core. The slots allow the member one end to be pressed inwardly by the tube, providing a good press-fit between the step tube and the first member.

The second member generally resembles the embodiment described above and has a open end and a closed end. The open end lies in a plane which forms a right-angle with a longitudinal axis of the insert and is provided with a flange adapted to rest against an opening in the mold assembly core member. The open end of the second member is force-fitted into a second end of the first member. The diagonally-aligned flange on the first member, engages a marginal portion of the core surrounding the opening in the core to hold the insert assembly in the proper position and to further seal the opening in the core mold member as the casting material is poured into the mold assembly.

The first member is scored in the region of the diagonally-aligned flange on the side of the first member extending into the cast member, enabling the portion of the first member extending into to cast member to easily break away from both the second member and the cast member when the cast member, after having set, is pulled out of the mold assembly. The portion of the first member remaining in the step tube is removed from the step tube in readiness for receipt of a first member of another insert assembly in preparation for molding another cast member.

OBJECTS OF THE INVENTION

It is therefore one object of the present invention to provide an integral cover tab on members utilized in the production of cast members for sealing precision cut mounting slots during the casting operation to prevent seepage there through.

It is another object of the present invention to provide an integral cover tab on wire reinforcement support members utilized in the production of cast members for sealing precision cut mounting slots during the casting operation to prevent seepage there through.

It is still another object of the present invention to provide an integral cover tab on manhole step insert members utilized in the production of cast members for sealing precision cut mounting slots during the casting operation to prevent seepage there through.

It is still another object of the present invention to provide a novel insert for cast members produced employing the wetcast method and which is adapted to receive the insertable leg of a step having a circular cross-section.

Still another object of the present invention is to provide a novel insert for use in a drycast method and which is designed to prevent seepage of the cast material into the mechanism of the mold assembly.

Still another object of the present invention is to provide a novel step for use in a wetcast method wherein the insert is keyed to a insertion pin to assure proper mounting and alignment thereof.

Still another object of the present invention is to provide a novel insert for step members produced in either a wetcast or drycast method and having an internal serrated design which provides increased frictional holding forces acting against forces which may be applied in a direction to pull the step out of the insert.

It is still another object of the present invention to provide a novel two-piece insert for cast members produced employing the wetcast method and which is adapted to receive the insertable leg of a step having a circular cross-section.

It is still another object of the present invention to provide a novel two-piece insert for cast members produced employing the wetcast method and which is adapted to seal the opening in the core mold member during casting of a mold member.

BRIEF DESCRIPTION OF THE FIGURES

The above as well as other objects of the present invention will become apparent from a consideration of the specification and drawings of the present invention, in which:

FIG. 5 is a top plan view showing a step having an insertable portion thereof provided with a circular cross section.

FIG. 6 show a cross section of an insert designed in accordance with the principles of the present invention and which is usable with the steps of FIG. 5.

FIG. 6*a* is an end view of the insert of FIG. 6.

DETAILED DESCRIPTION OF THE INVENTION AND PREFERRED EMBODIMENTS THEREOF

Figure 1A:
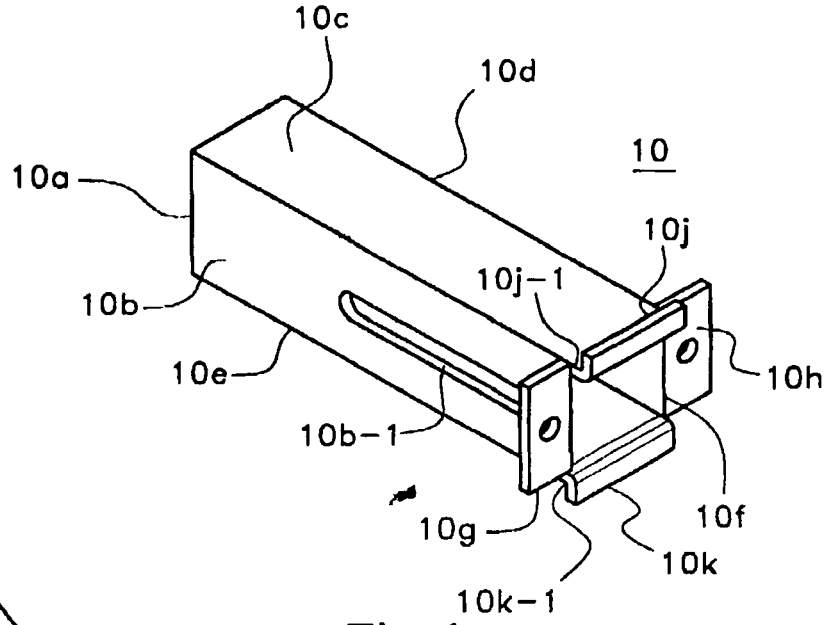
FIG. 1*a* is a perspective view of a conventional manhole step insert.
Figure 2A:
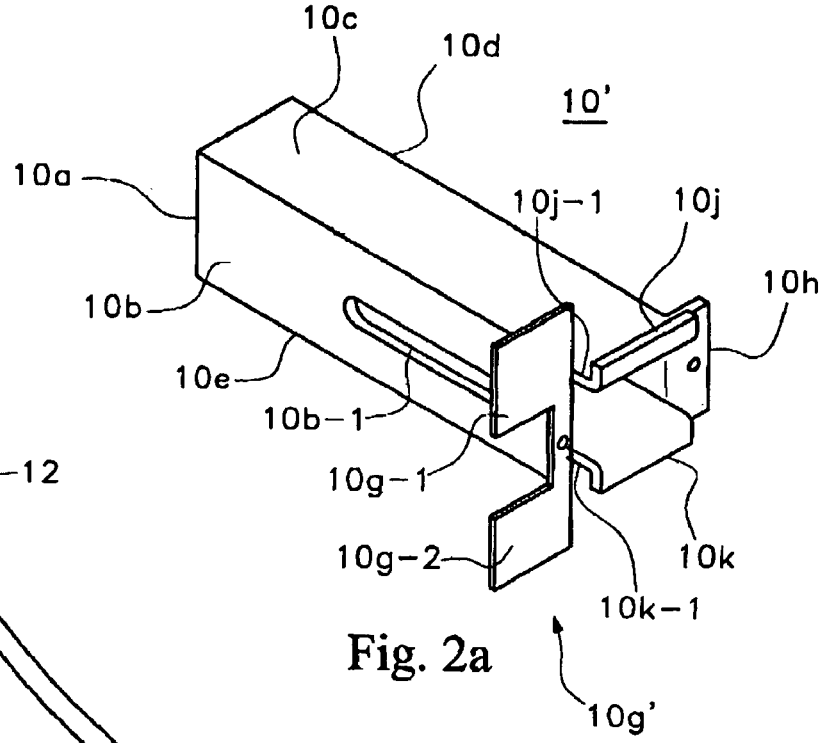
FIG. 2*a* is a perspective view of a manhole step insert embodying the principles of the present invention.

FIG. 2*a* shows a manhole step insert 10' embodying the principles of the present invention and which has been labeled such that like numerals as between FIGS. 1*a* and 2*a* designate like elements and a description of only the new elements will be provided herein for purposes of simplicity.

The flange 10*g* of the conventional manhole step insert 10 shown in FIG. 1*a* is replaced by a new cover tab structure 10*g*' integrally joined to the right-hand end of sidewall 10*b* and having cover tab portions 10*g*-1 and 10*g*-2.

Figure 2B:
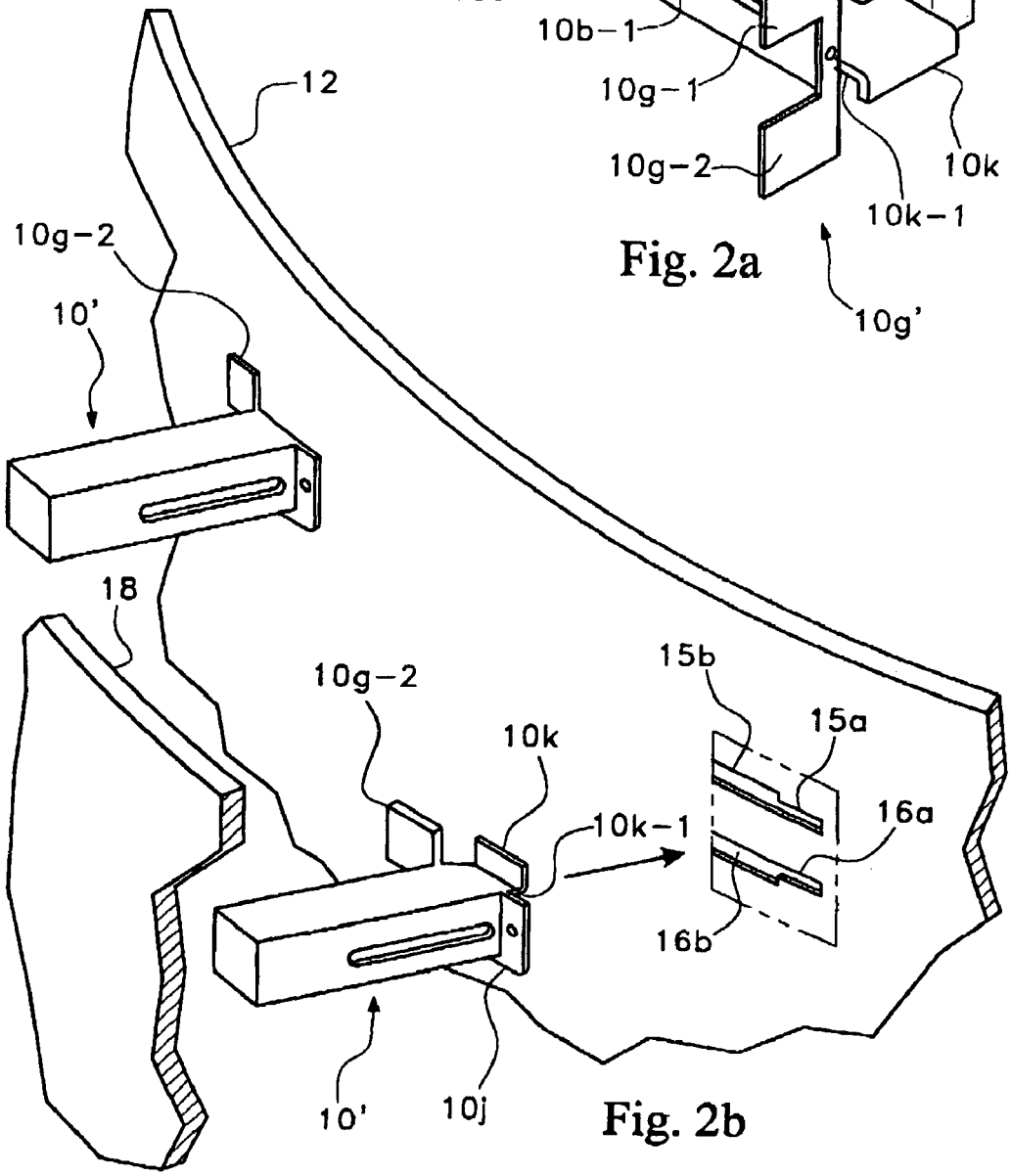
FIG. 2*b* is a perspective view showing a portion of a mold assembly and the manner in which the manhole step insert of FIG. 2*a* is utilized to prevent seepage.

Making reference to FIGS. 2*a* and 2*b* the manhole step insert 10' is aligned so that its cover tabs 10*g*-2 and 10*g*-1 extend in a leftward direction. Step insert 10' is in a position so that the flanges 10*k* and 10*j* are in alignment with the wide diameter slot portions 15*b*, 16*b* respectively. The flanges 10*k* and 10*j* are pushed through slot portion 15*b*, 16*b*, which are of a width sufficient to enable flanges 10*k* and 10*j* to be pushed there-through.

The manhole step insert 10' is pushed until it is flange 10*j* and cover tabs 10*g*-1, 10*g*-2 engage the convex surface of the inner mold shell 12 at which time the flanges 10*k*, 10*j* are clear of the slots 15*b*, 16*b*. At this time, the manhole step insert 10' is pushed to slide in a rightward direction so that the extension portions 10*k*-1, 10*j*-1 respectively joined to flanges 10*k* and 10*j* enter into the narrow width slot portions 15*a*, 16*a*. Further sliding is prevented when the right-hand edges of projections 10*j*-1 and 10*k*-1 respectively abut against the right hand ends of slots 15*a*, 16*a*. At this time, cover tabs 10*g*-2 and 10*g*-1 extend over and substantially seal slots 15*b*, 16*b*. When all of the manhole step inserts 10' are mounted in this fashion, the mold assembly is filled with cast material (typically concrete). The cover tabs 10*g*-1, 10*g*-2 substantially seal slot portions 15*b*, 16*b* preventing any seepage therethrough and further preventing the occurrence of a honeycomb structure typically encountered when using conventional manhole step inserts lacking the cover tabs of the present invention.

Figure 4A:
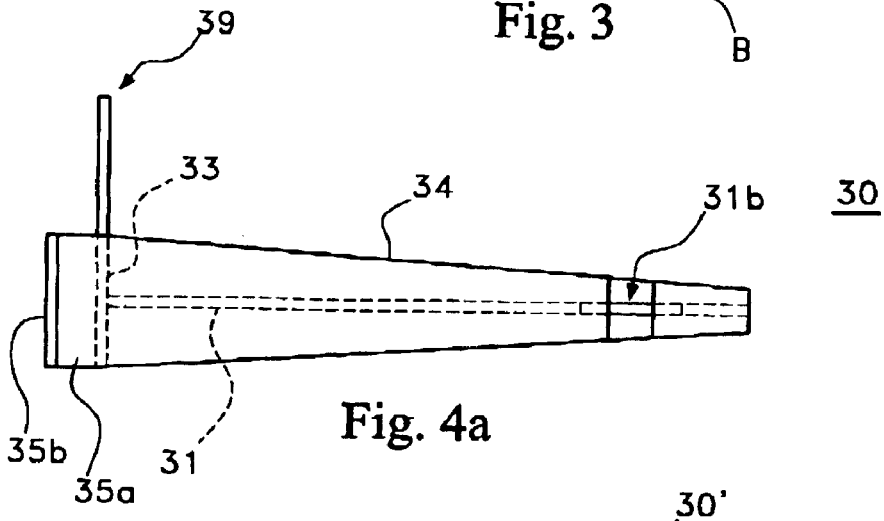
FIGS. 4*a*, 4*b* and 4*c* respectively show top, side and front views of a support incorporating the protective cover tabs.
Figure 4B:
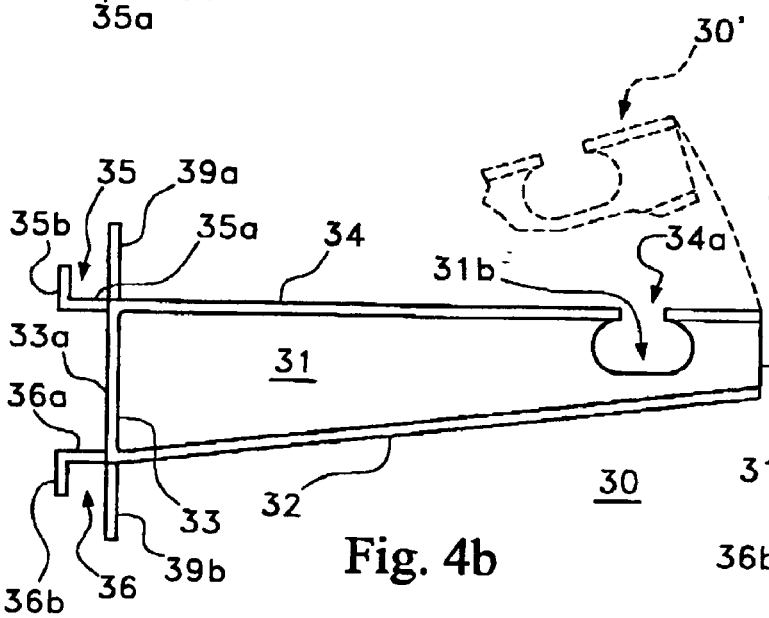
Figure 4C:
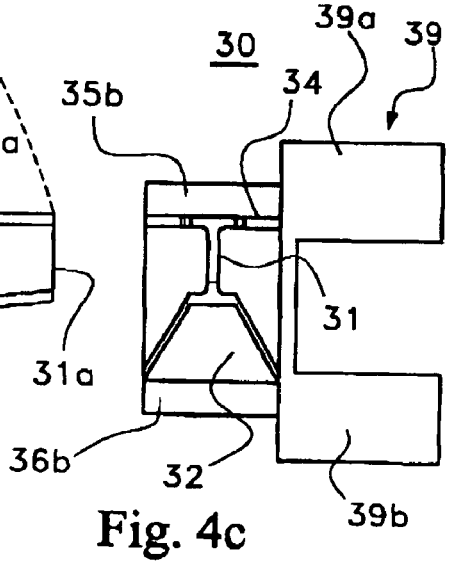

FIGS. 4*a*, 4*b* and 4*c* show still another embodiment 30 for slidable mounting to a mold member and utilized as a support for wire hoops employed in cast members to enhance structural strength of the cast member and functioning in the same manner as the embodiments described in detail in co-pending application Ser. No. 08/853,515 filed May 9, 1997 and incorporated herein by reference thereto.

The support 30 has a main body portion 31 which is wider at its left-hand end and tapers to a narrow right-hand end 31*a*. A lower reinforcement flange 32 is integrally joined to the lower en of main body portion 31 forming a substantially inverted T-shaped configuration. A left-hand end reinforcement flange 33 is integrally joined to the left-hand end of main body portion 31 forming a substantially T-shaped cross section as shown best in FIG. 3*a*.

The top end of main body portion 31 is joined to an integral upper reinforcement flange 34 forming a substantially T-shaped cross section with main body portion 31. A substantially oval-shaped slot 31*b* is formed in main body portion 31. The portion 34*a* of upper flange 34 immediately above slot 31*b* is likewise removed to enable insertion of a wire hoop into the slot 31*b*.

A pair of supporting flanges 35 and 36 are joined at the left-hand (i.e., mounting) end of the support 30, the upper flange located at the corner defining the merger between flanges 33 and 34 and the lower mounting flange 36 being located at the corner defining the merger of flanges 32 and 33.

Flanges 32 and 34, as can best be seen in FIGS. 3*a* and 3*c*, have a tapered shape and are wider at their left-hand ends where they merge with flange 33, and taper to a narrow width where they terminate together with the right-hand end 31*a* of main body portion 31.

Upper mounting flange 35 has a flange portion 35*a* extending away from flange 33 and a portion 35*b* extending upwardly and at right angles from flange portion 35*a*. Similarly, the mounting flange 36 has a flange portion 36*a* extending away from flange 33 and a flange portion 36*b* extending downwardly and at right angles from flange portion 36*a*. The width of flanges 35 and 36 can be seen to be equal to the maximum width of flanges 32 and 34 as well as the substantially constant width of flange 33. A flange 39 integrally joined to one vertical side of reinforcement flange 33*a* extends outwardly therefrom and is provided with cover tabs 39*a*, 39*b*.

Figure 3:
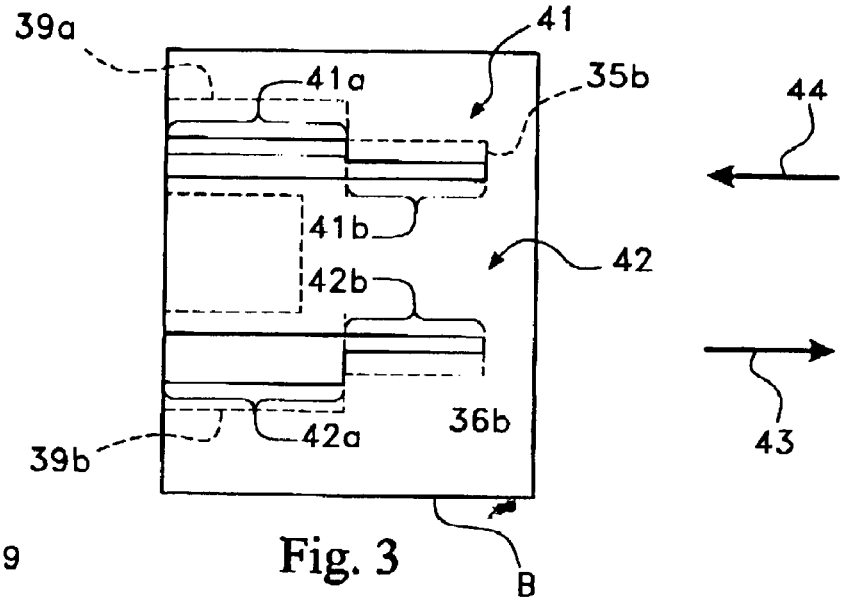
FIG. 3 is a detailed plan view showing a blank having precision cut slots of the type employed in FIGS. 1*b* and 2*b* which is useful in explaining the detailed structure thereof.

The manner in which the support 30 is mounted within a mold assembly can be best understood from a consideration of FIG. 3, together with FIGS. 4*a* through 4*c*.

Figure 1B:
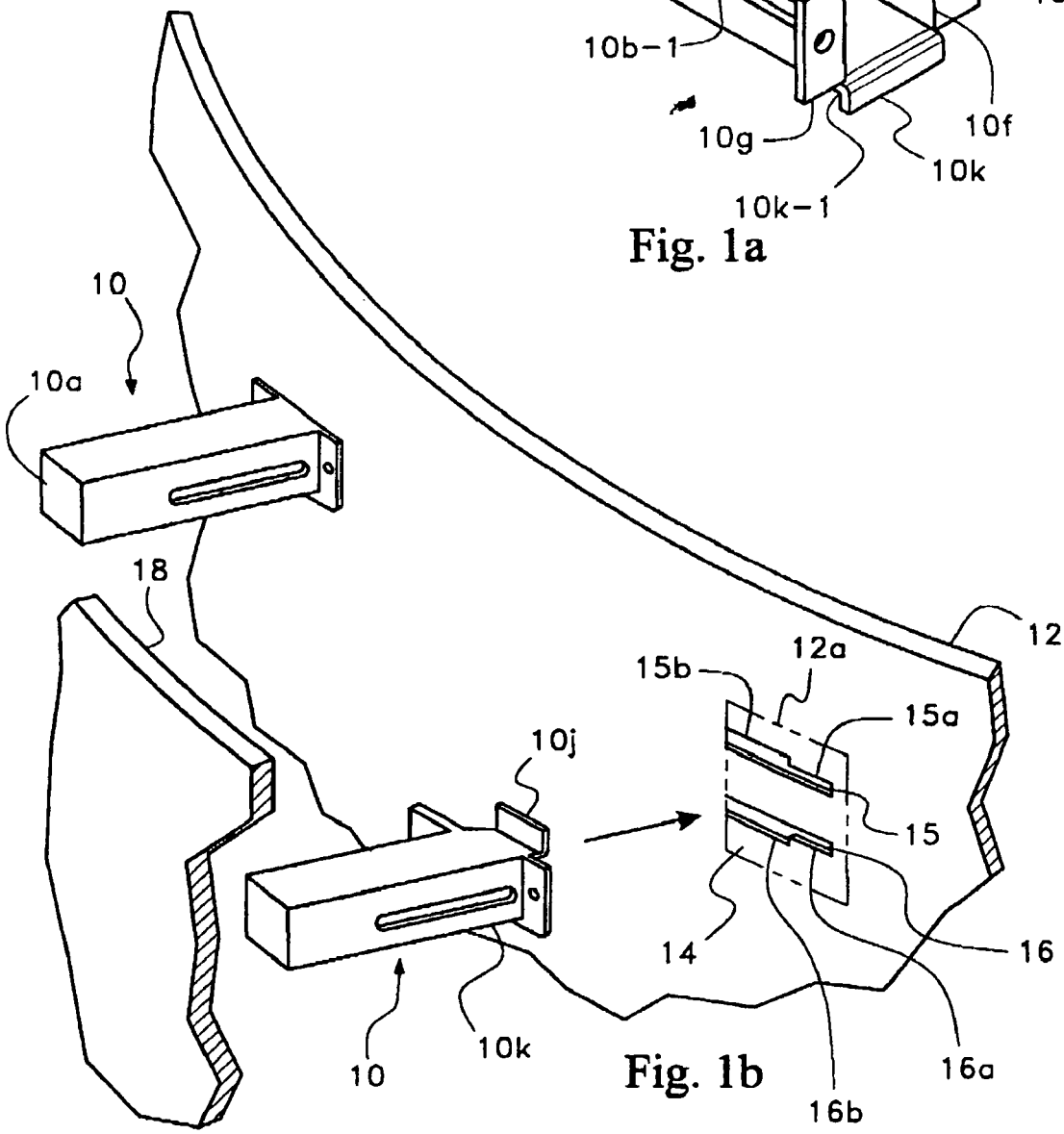
FIGS. 1*b* and 1*c* are perspective views useful in explaining the manner in which the insert of FIG. 1*a* is utilized.

One of the mold members, preferably the mold member defining the interior wall of the man-hole to be cast is provided with a pair of elongated slots 41 and 42 (similar to the slots 15 and 16 shown in FIGS. 1*b* and 2*b*). Slot 41 has a slot portion 41*a* which has a width greater than the width of slot portion 41*b*. Similarly, elongated slot 42 has a slot portion 42*a* of a width greater than the slot portion 42*b* and preferably of a width greater than the slot portion 41*a*.

The manner in which the support 30 is mounted into the precision cut slots is as follows:

The support 30 is tilted so that its end 31*a* is swung through an angle from the horizontal position shown in FIG. 4*b* to the dotted line position 30, also shown in FIG. 4*b*.

With the support 30 at the orientation 30', the flange 35 is brought substantially into alignment with slot portion 41*a* and flange portion 35*b* is slipped into slot portion 41*a* (the width w1 of slot portion 41*a* is slightly less than the height h of flange portion 35*b*).

With the flange portion 35*b* now inserted into slot portion 41*a*, the support is tilted downwardly to move flange 36 into alignment with slot portion 42*b*. Sufficient clearance is provided to allow flange portion 36*b* to enter into slot portion 42*a* (the width w2 of slot portion 42*a* is slightly greater than the height h of flange 36*b*). The left-hand surface 33*a* of vertical flange 33 is positioned against the region R between slots 41*a* and 42*a*. With support 30 in this position, the support 30 is moved to the right as shown by arrow 43, causing the flange portions 35*b* and 36*b* to embrace the opposite surface of the mold member while flange portions 35*a* and 36*a* are captured within slot portions 41*b* and 42*b* (the width w3 of the slots 41*b* and 42*b* are slightly less than the height h of the flanges 35*b* and 36*b*).

Slot portions 41*b* and 42*b* firmly lock support 30 into position and the only way that the support can be removed is by breaking off flanges 35 and 36 or alternatively by moving support 30 in the direction of arrow 44 to return the flanges 35 and 36 to the region of flange portions 41*a* and 42*a* for removal.

The cover tab assembly 39, which is integral with the support 30, is comprised of cover tabs 39*a*, 39*b* similar in design and function to the cover tabs 10*g*-1, 10*g*-2 provided as an integral part of insert 10, as shown in FIG. 2*a*. The cover tabs seal the larger width slot portions 41*a*, 42*a* in the manner shown in dotted fashion in FIG. 3.

As was previously described, it is preferable to provide precision cut blanks having slot arrangements 41 and 42 at 1200 intervals about the inner-mold member. Once the supports 30 are mounted in the fashion described hereinabove, the wire hoops are inserted into the support slots 31*b*. It should be understood that a greater or lesser number of supports may be provided to support each hoop and, depending upon the height of the member being cast, the number of circular arrays may be modified. For example, FIG. 6 of application Ser. No. 08/853,515 referred to above shows the use of three reinforcement hoops at three different positions within the height of the cast member. A greater or lesser number may be utilized as a function of the height of the member being cast and the structural strength desired.

The pairs of slots 41 and 42 utilized for mounting supports may be machined into the mold member or, alternatively, the slots may be formed in a rectangular-shaped blank B and the blank may be inserted into an opening formed in the mold member to accommodate blank B. Blank B is then joined, for example, by welding, to the mold member.

Although the supports 30 are preferably arranged to be supported by the inner mold member, as shown in FIG. 6, the supports may be joined to the outer mold member, if desired.

When the supports 30 are arranged so that the flanges 35*b*, 36*b* are in the dotted line positions shown in FIG. 4, the cover tabs 39*a*, 39*b* occupy the positions shown in dotted fashion in FIG. 4 sealing the slots 41*a*, 42*a* to prevent seepage therethrough. When the supports are properly positioned and the metal hoops are properly mounted, the cast material is poured into the mold assembly. The reinforcement flanges 32, 33 and 34 provide significantly increased structural strength which is more than sufficient to withstand the concrete being poured into the mold. Once the mold is filled and the cast material has been set, the cast member is removed from the mold assembly. During removal, flanges 35 and 36 easily break away from flange 30 in a manner similar to the broken flanges E shown in FIG. 1*c*.

Since the flanges 35 and 36 and specifically the flange portions 35*a* and 36*b*, are oriented substantially horizontally, their thickness and structural strength in the vertical direction is minimal, enabling the flanges to easily break-away from support 30.

Figure 1C:
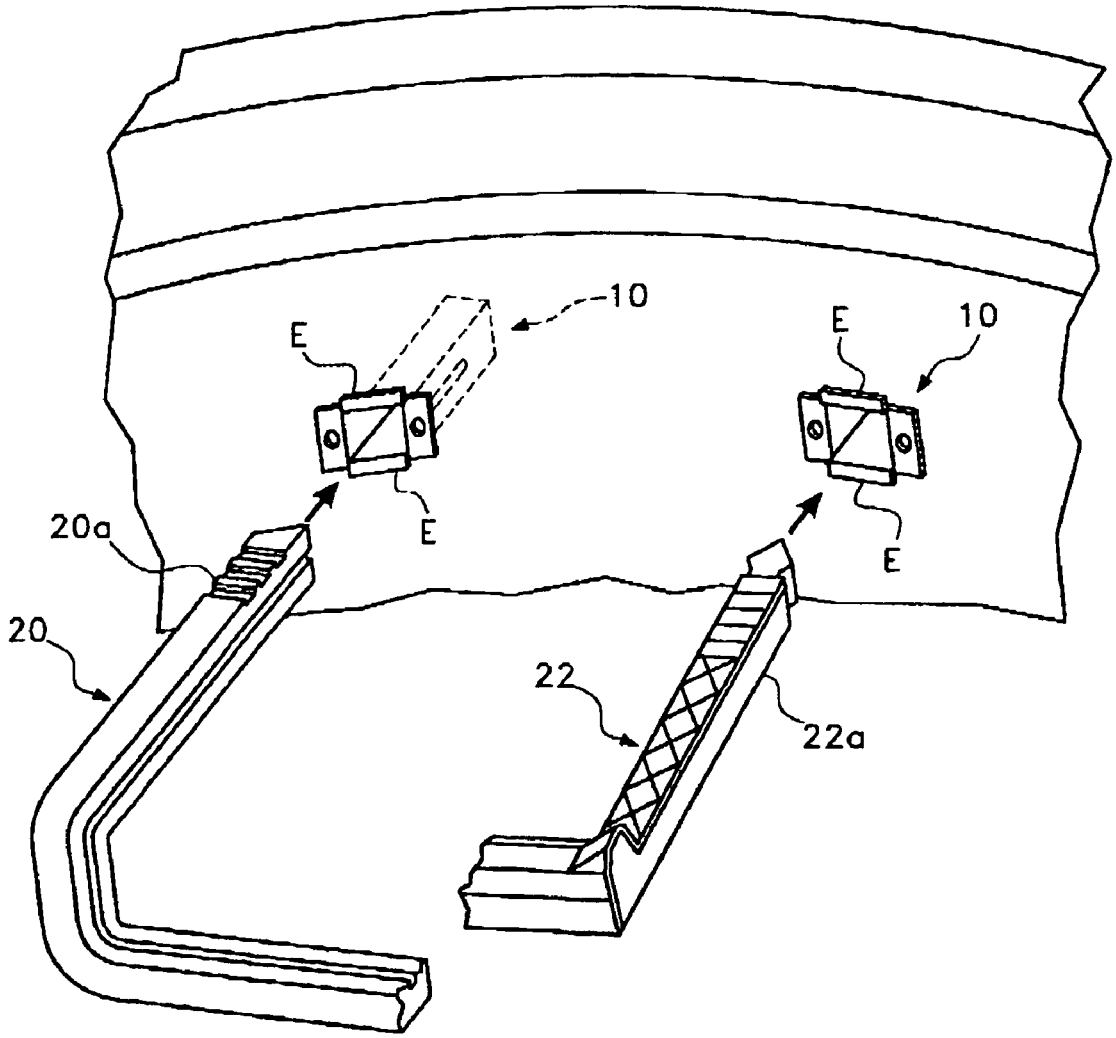

FIG. 5 shows a step 20' which differs from the step 20 shown in the FIG. 1*c* in that the step 20', and which is formed of suitable plastic material and is typically provided with a reinforcing metallic frame embedded within the plastic material, has legs 22*a*' provided with a tapered, conical-shaped tip 22*a*-1' which merges with a portion 22*a*-2' of generally cylindrical and yet slightly tapering shape which then merges with a serrated portion 22*a*-3'. The serrated portion is made up of a plurality of individual annular flanges F, each of which has an inclined surface F1 which is inclined at an angle to a longitudinal center-line CL on a side of each flange and a surface F2 which is substantially perpendicular to the center-line CL and which is on the side of each flange remote from the free end thereof. This design is such as to make it easier for insertion of the legs 22*a*' into insert 20' whereas any effort or attempt to pull the legs 22*a*' out of an insert 20' is met with an increased frictional holding force, due to the "one way" design of the serrated portions 22*a*-3'.

FIG. 6 shows a cross-sectional view of the step insert 20' for employment in the fabrication of assemblies made using the drycast method and FIG. 6*a* shows a top view of the insert looking in the direction of arrows 6*a*—6*a* of FIG. 6.

Any suitable drycast method capable of utilizing hydraulically operated insert pins, may be employed with the present invention.

Figure 7:
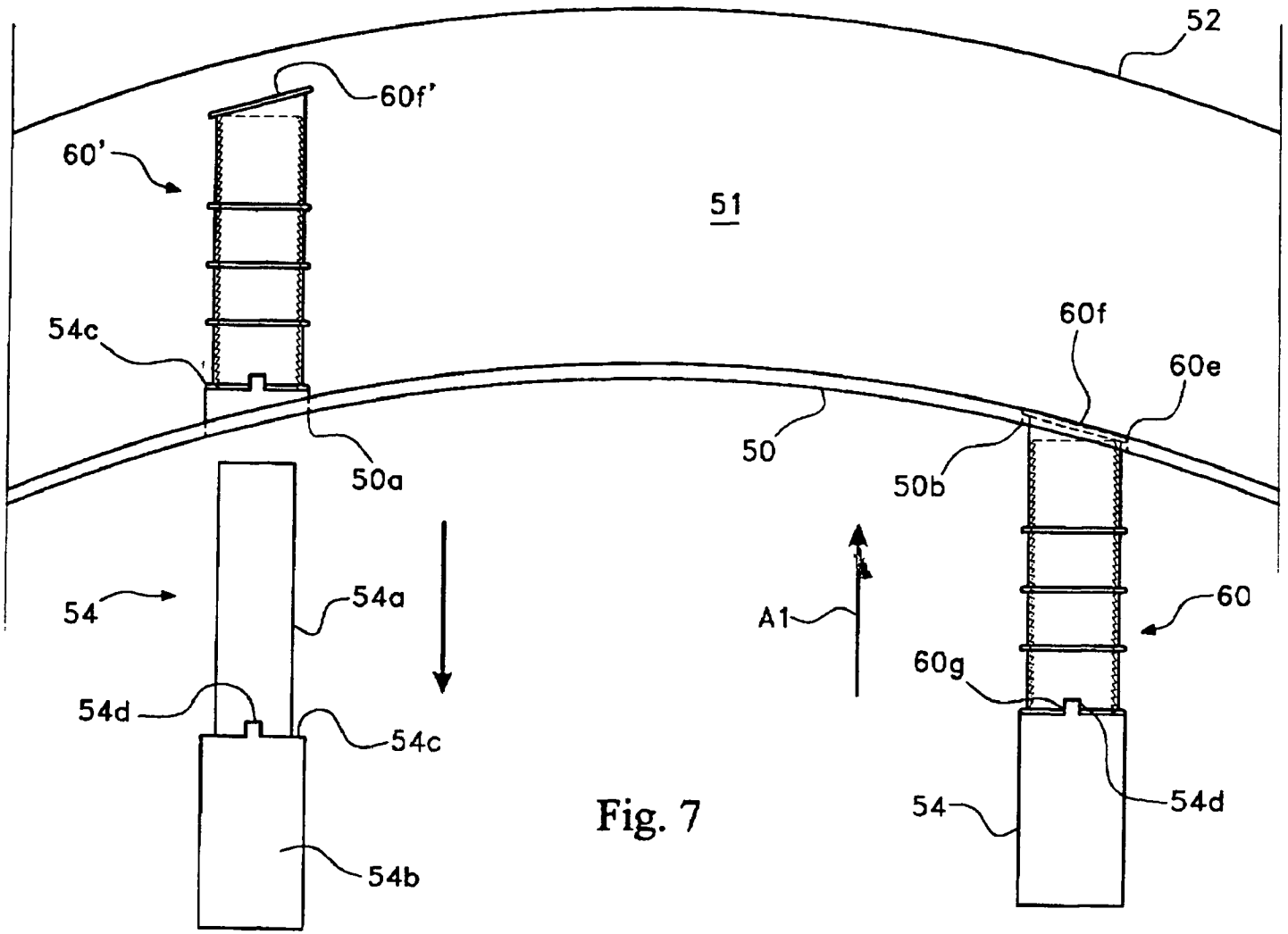
FIG. 7 shows the developmental steps employed in the utilization of the step insert of FIG. 6 when using the wetcast method.

Making reference to FIGS. 6, 6*a* and 7, the drycast method employs a core member 50 having a curved convex surface which serves to form the interior surface of the cast member being formed by providing dry material in the region 51 between core 50 and outer jacket 52, which mold assembly has been shown in highly simplified fashion.

The core member 50 is provided with circular-shaped openings 50*a*, 50*b* which are precisely arranged so as to provide the proper relationship between openings formed in the cast member and the legs 22*a*' of the step 20'.

When the cast material reaches an appropriate level and has been sufficiently vibrated, tamped down and the like, a pin 54 is operated by suitable hydraulic means (not shown for purposes of simplicity) to project out of core 50 and into the casting material.

The pin assembly 54 has a cylindrical shape and is comprised of a first portion 54*a* of a first diameter integrally joined to a second cylindrical portion 54*b* having a diameter larger than portion 54*a* so as to form a shoulder 54*c* therebetween. A projection 54*d* is arranged at one point along shoulder 54*c* and extends in an axial direction along the smaller diameter portion 54*a*.

It should be understood that the pin assembly 54 shown is modified from conventional pins to provide the design shown incorporating the smaller diameter portion 54*a*, larger diameter portion 54*b*, ledge 54*c* and projection 54*d*.

The insert 60 shown in FIGS. 6, 6*a* and 7 has a substantially circular cross-section and is comprised of a closed end 60*a* and an open end 60*b*. The outer periphery 60*c* is provided with a plurality of outwardly directed annular flanges 60*d* arranged at spaced intervals therealong. The closed end 60*a* also incorporates a flange 60*e*. Flanges 60*d* all lie within planes which are substantially perpendicular to the longitudinal center line or axis CL of insert 60. The outer surface 60*d* of closed end 60*a* is likewise substantially planar but is diagonally aligned relative to center line CL.

The open end 60*b* is provided with two alignment slots 60*g*, each of which is designed to receive the projection 54*d* of pin assembly 54 thereby assuring that the insert is aligned with proper orientation upon pin assembly 54 as will be understood from the description set forth below. Noting the right-hand insert 60 shown in FIG. 7, the insert is mounted upon the right-hand pin assembly 54 with projection 54*d* received within slot 60*g*. The flange 60*d* located at the open end rests upon ledge 54*c*, as shown. In the position shown in FIG. 7, with the pin assembly 54 in the "ready" position and the insert 60 properly mounted and aligned thereon, it can be seen that the planar surface 60*f* is substantially flush with the outer convex surface of core 50 and that the flange 60*e* serves to substantially completely seal opening 50*b*, preventing seepage of the casting material into the core assembly.

When the cast material has been duly and properly vibrated and compacted, the hydraulic mechanism (not shown) operating pin 54, moves the pin assembly 54 in the direction shown by arrow A1, urging the pin and the insert 60 mounted thereon into the cast material so as to ultimately occupy the final position shown by the left hand-insert 60'. The pin assembly 54 is designed so as to cause the ledge 54*c* to enter into the cast material, whereby the open end of the insert 60' is recessed into the cast member so that when the pin assembly 54 is withdrawn from the cast member into the mold core 50 there is no wiping action of the insert 60' against the core, thereby preventing both the core 50 and the cast member (together with the insert) from being damaged.

The insert is provided with slot 60*g* at two (2) diametrically opposed positions in order to provide an insert of universal design. The manner of use is such that the slot 60*g* which receives projection 54*d* aligns the insert 60 so that the diagonally aligned end 60*f* is flush with the concave surface of the core. By rotating the second insert 60', 180° relative to the first insert and placing this insert 60 on the left-hand pin and so that the opposite slot 60*g* receives pin 54*d*, this assures that the diagonally aligned closed end 60*f'* is flush with a concave surface surrounding the left-hand opening 50*a*.

As can be seen from the embodiment shown in FIG. 6*a*, the wall of the insert in the portion 60*j* as well as the closed in portion 60*f*, is of increased thickness to provide sufficient structural strength to enable the insert to retain its shape as it is pushed into the cast material during the practice of the drycast method. Alternatively, the thickness may be regulated to enhance or decrease cycle time. The amount of material may be reduced by providing cavities in the insert.

In equipment used for the drycast method wherein the interior region containing the hydraulically operated pins 54 is easily accessible, the inserts may be placed upon the pins when they are in a retracted position such as the left-hand pin 54 shown in FIG. 7. Alternatively, preparatory to insertion, vibration and tamping of the cast material, the pin assembly may be operated to extend into the region 51 whereupon the insert is placed upon the pin and properly aligned so that the projection 54*d* is received by the appropriate slot 60*g* and thereafter retracting the pin assembly 54 to the "ready" position shown by the pin 54 in the right-hand position of FIG. 7.

Figure 8:
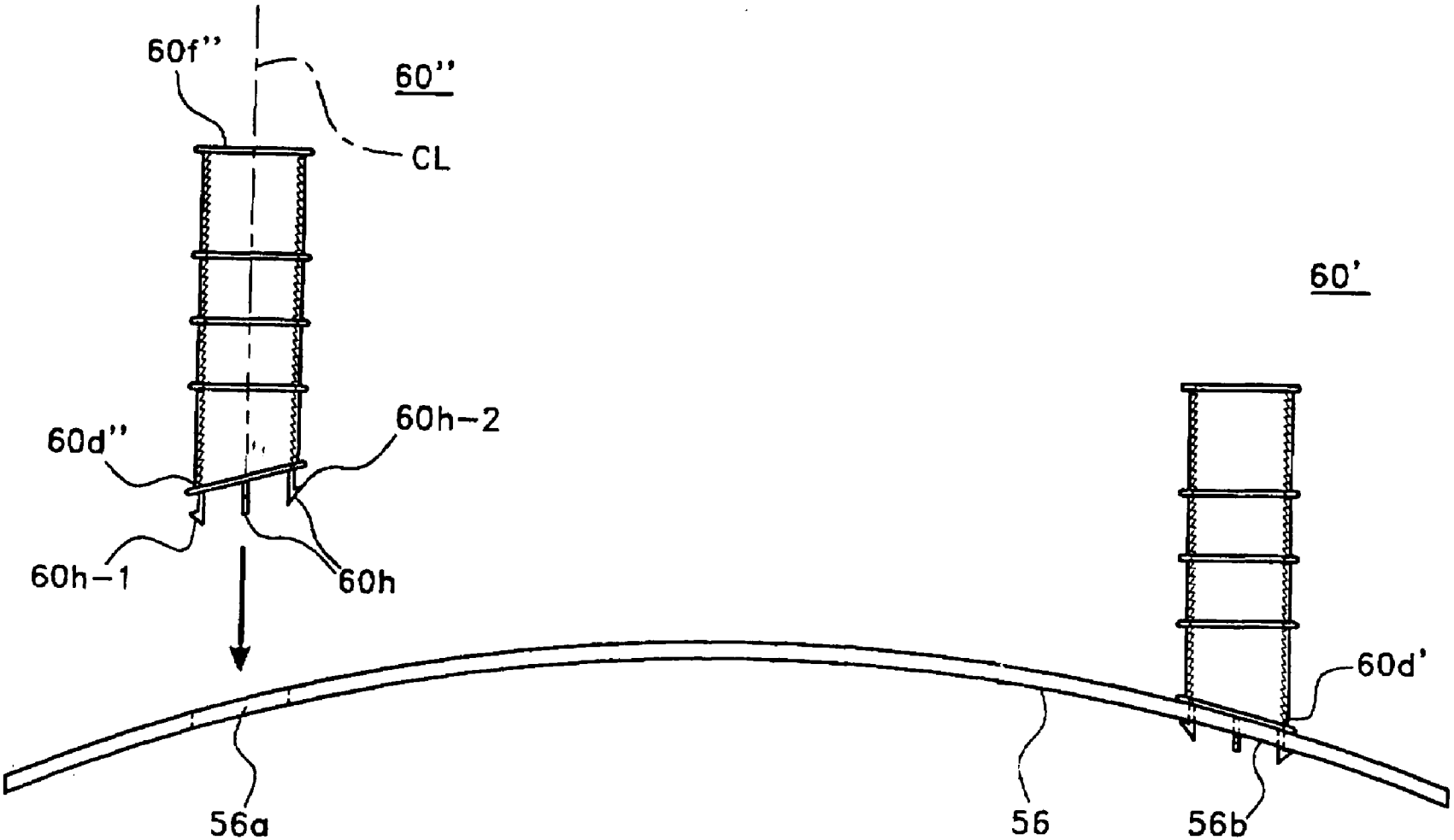
FIG. 8 shows the developmental steps employed in the utilization of the step insert of FIG. 6 when using the drycast method.

FIG. 8 shows the insert 60" employed in the manufacture of cast members using the wetcast method. In the utilization of mold assemblies employed in the wetcast method, the internal mold member or core 56 is provide with a pair of openings 56*a*, 56*b* similar to the openings provided in core 50 shown in FIG. 7. The insert 60" differs from the insert 60 (and 60') in that the closed end 60*f*", although being a planar surface, is aligned so as to be perpendicular to the center line CL of the insert 60".

The open end of insert 60" is further modified so that the flange 60*d*" immediately adjacent the open end lies in a plane which is diagonally aligned relative to center line CL. A plurality of ears 60*h* are integrally joined to the insert adjacent to the flange 60*d*" and project away from the opening and are substantially parallel to the longitudinal axis CL. Each ear 60*h* has a substantially hooked-shaped configuration and each ear is sufficiently flexible so that, as the ears are pushed into opening 56*a*, the inclined surfaces 60*h*-1 sliding engage the edge of the opening and cause the ears to be flexed substantially radially inwardly until the inclined surfaces 60*h*-1 clear the interior side of the opening, at which time the locking surface 60*h*-2 of each ear 60*h* grips a marginal portion of the inner mold member 56 surrounding opening 56*a* on the interior side of core 56 as the flexed ears return to their normal unflexed position, whereby the insert 60" is locked into position with the ears engaging marginal portions along the interior concave surface of core 56 while flange 60*d*" rests against a marginal portion surrounding the exterior convex portion of the core 56 surrounding opening 56*a*. Flange 60*d*" prevents fines from entering into the interior of the mold member 56.

The insert utilized for both the left and right-hand positions i.e. for insertion into the left and right-hand openings 56*a*, 56*b*, are identical in design to one another. The proper orientation of the inserts relative to the mold member 56 is obtained by rotating each insert so that the flange 60*d*" rests against the external, curved convex surface of core 56. Thus, the insert inserted into the right-hand opening 56*b* is rotated 180° about its center line relative to the insert inserted into opening 56*a* so that the inserts are aligned with their longitudinal axes CL substantially parallel to one another to assure proper alignment with the insertion portions of step 20' (see FIG. 5). The ears 60*h* are preferably aligned at equiangular intervals. Preferably, at least three (3) ears are provided at 120° intervals. Alternatively four (4) ears may be provided arranged at 90° intervals. A greater number of ears may be provided if desired.

After the inserts are snapped into position the cast material is poured into the mold. When the cast material has been set, the cast member is pulled out of the form, whereupon the ears 60*h* shear off as the cast member is removed from the mold. The ears 60*a* are of a strength sufficient to retain the inserts in position during the casting operation and yet adapted to be easily sheared away from the main body of the insert when the cast member has been set and is pulled away from the mold.

The interior design of the insert 60" is substantially identical to the design of insert 60 to obtain the "one way" feature of the internal serrations for assuring the positive retention of the legs of the step within the inserts.

Testing has indicated that the inserts 60 and 60" are capable of withstanding as much as four (4) times the normal pulling force (1600 lbs. pulling force), the normal pulling force being of the order of 400 lbs. capability.

Figure 9:
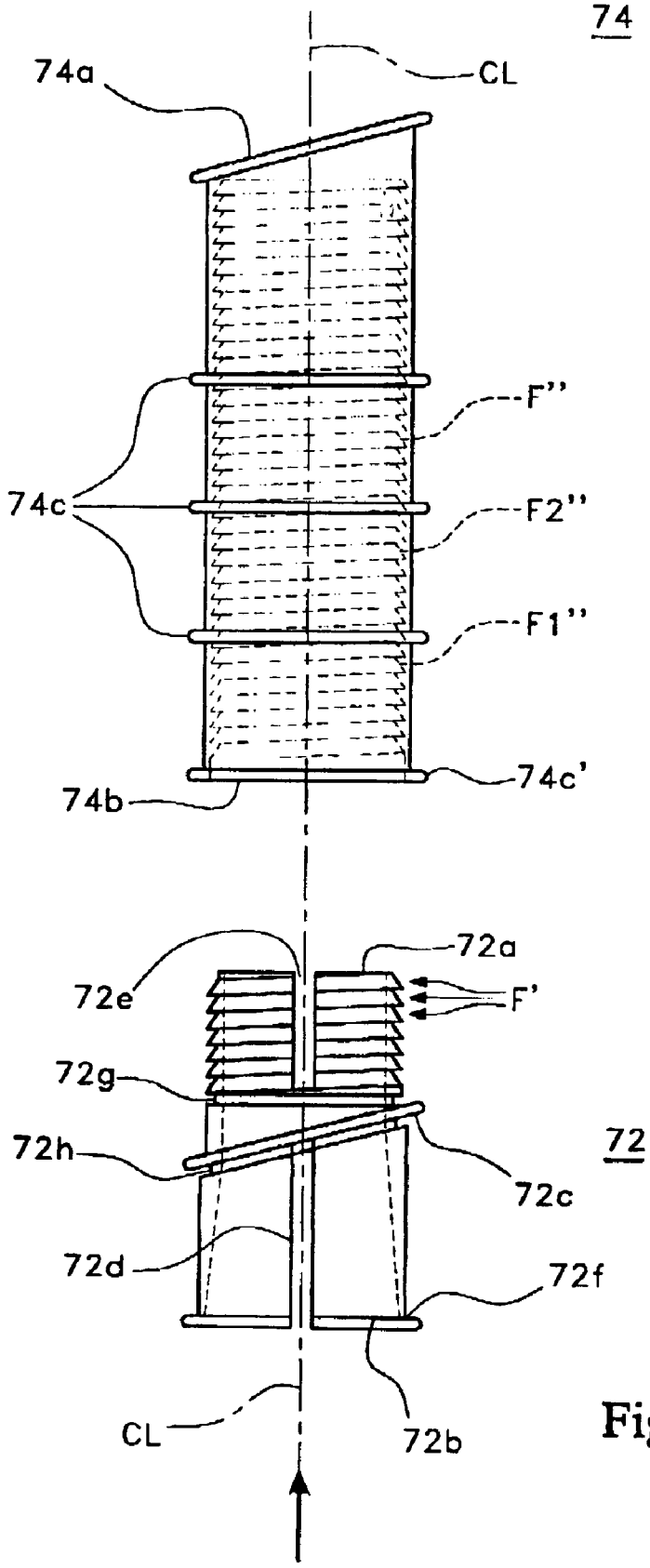
FIG. 9 is an exploded view of a two-piece insert assembly for use in the wetcast method.

The two-piece insert assembly embodiment 70, shown in FIG. 9 is comprised of first and second hollow, cylindrical-shaped, molded, plastic members 72 and 74. Member 72 has open ends 72*a* and 72*b*. A flange 72*c* provided intermediate ends 72*a* and 72*b* lies in a plane which is diagonally aligned relative to the central axis CL. Two (2) slots 72*d* are arranged at 180 degree intervals about the end 72*b* of member 72 and extend inwardly from end 72*b* toward flange 72*c*. Another set of two (2) slots 72*e* are arranged at 90 degree intervals about the end 72*a* of member 72 and extend inwardly from end 72*a* toward flange 72*c*. However, the inward end of slots 72*e* terminate a spaced distance from flange 72*c*. If desired, the number of slots 72*d*, 72*e* may be three or even four or more slots arranged a egui-spaced intervals about the circumference of member 72.

The major portion of member 72 extending between and 72*a* and flange 72*c* has a plurality of individual annular flanges F', similar to the flanges F on the step 20', each of which has an inclined surface F1' which is inclined at an angle to a longitudinal center-line CL on a side of each flange and a surface F2' which is substantially perpendicular to the center-line CL and which is on the side of each flange remote from the end 72*a*. Alternatively, the surface F1' may be aligned perpendicular to the central axis CL. This design is such as to make it easier for insertion of the end 72*a* into insert member 74, whereas any effort or attempt to pull the insert member 74 out of insert member 72 is met with an increased frictional holding force, due to the "one way" design of the serrated or flanged portions F'.

Insert member 74 had a closed end 74*a* and an open end 74*b*. End 74*a* has a planar surface which is diagonally aligned relative to center line CL and terminates in an integral annular flange, similar to the embodiment 60 shown in FIG. 6. The exterior of member 74 is further provided with a plurality of integral flanges 74*c* and 74*c*', all of which are planar and lie in planes forming right-angles with the center line CL.

The interior periphery of member 74 is provided with a plurality of inwardly directed, annular flanges F", having an inclined surface F1" which is inclined at an angle to the longitudinal center-line CL and a surface F2" which is substantially perpendicular to the center-line CL and which is on the side of the flange remote from the end 74*b*. This design is such as to make it easier for insertion of the end 72*a* into insert member 74, whereas any effort or attempt to pull the insert member 74 out of insert member 72 is met with an increased frictional holding force, due to the "one way" design of the serrated or flanged portions F' and F".

Figure 10:
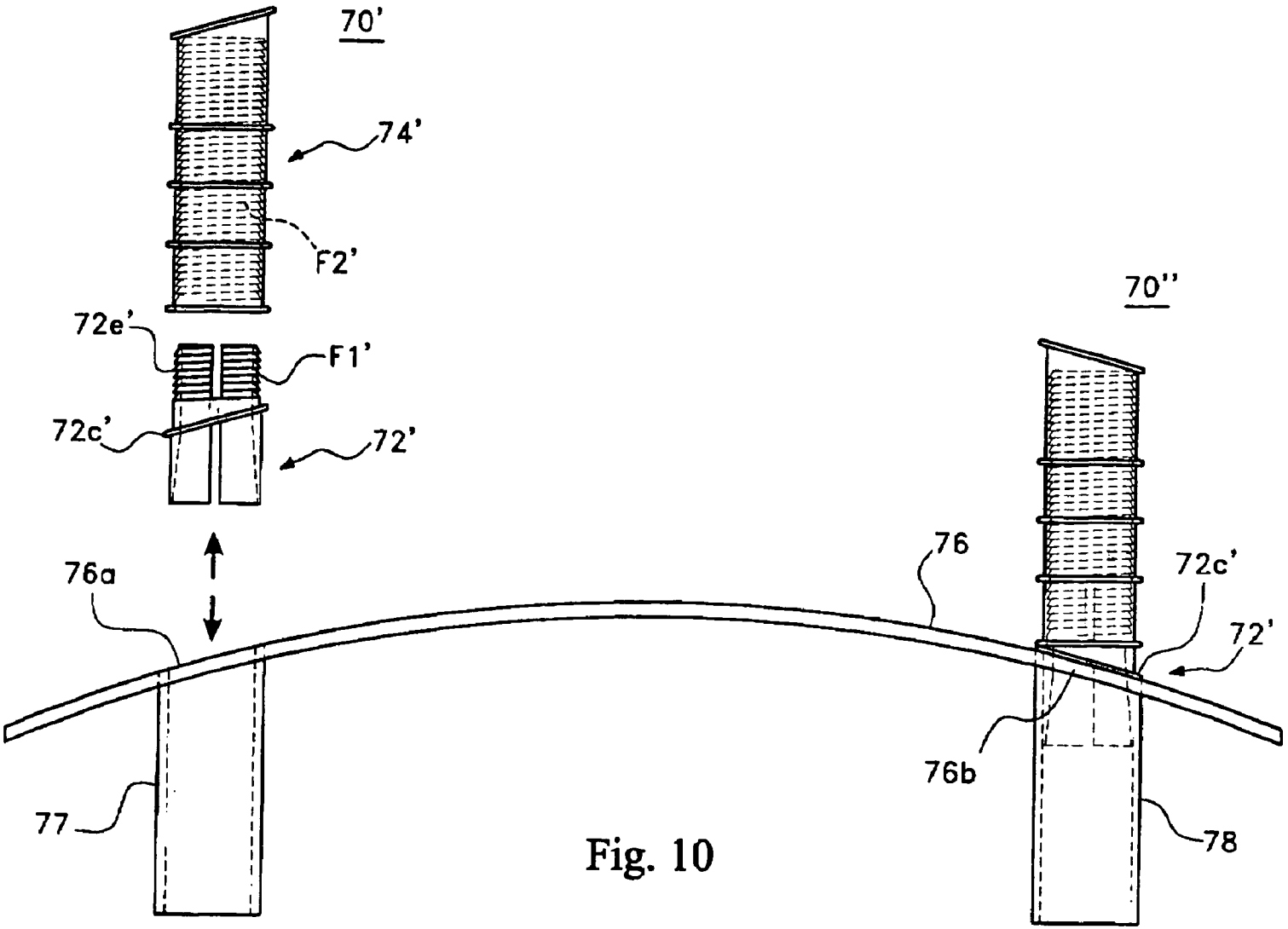
FIG. 10 shows the developmental steps employed in the utilization of the two-piece step insert assembly of FIG. 9 when using the wetcast method.

The manner in which the insert assembly 70 is employed in the wetcast method will now be explained making reference to FIG. 10.

The core mold member 76 is provided with a pair of circular-shaped openings 76*a*, 76*b*. Step tubes 77, 78 are welded to the core member 76 in the manner shown. The end of each step tube joined to core 76 is defined by an edge which lies in a plane that is diagonally aligned to the longitudinal axis of the step tube. Each step tube is aligned with its associated opening 76*a*, 76*b*.

Member 72' is inserted into opening 76*a* from the convex surface side of core 76 and enters into step tube 77. The integral bead 72*f* at the open end 72*b* has an outer diameter which is greater than the inner diameter of opening 76*a* and step tube 77, causing the sides of member 72*a* to be pressed inwardly. The sides of member 72' are yieldable due to the slots 72*d*. Member 72' is pushed into tube 77 until the flange 72*c*' engages the marginal portion of core 76 surrounding opening 76*a*. Member 74' is then pushed onto member 72. The slots 72*e*' enable the sides of member 72' to yield while providing a good force-fit between members 72' and 74'. The one-way flanges F' and F" make it easier to telescope member 74' onto member 72' while providing a snug fit as well as making it harder to pull members 72 and 74 apart.

Flange 72*c*' seals opening 76*a* preventing fines from entering into the opening 76*a*. It should be understood that an insert assembly 70" can be mounted upon opening 76*b* in a similar fashion to that described above with regard to assembly 70. Alternatively, member 74 may be telescopingly mounted upon member 72 before member 72 is inserted into step tube 77.

When the insert assemblies have been properly mounted upon core 76, the casting material is poured into the mold assembly. After the casting material has set, the cast member is pulled out of the mold assembly. Member 72 is scored in the region of flange 72*c*. The two substantially circular-shaped scored areas 72*g*, 72*h* respectively located just below the annular projection F' closest to the diagonal flange 72*c* and just below the diagonal flange 72*c*, preferably are formed by reducing the thickness of the first member in these regions as shown in FIG. 9, to facilitate breaking away of the portion of member 72 between diagonally-aligned flange 72*c* and the annular projection F' closest to flange 72*c*. The first member 72 thus breaks into three parts, so that the portion having the annular projections F' remains inside of second member 74; the portion between the flange 72*c* and end 72*b* remains inside of the step tube 77 and the remaining portion intermediate the portions remaining inside member 74 and step tube 77 breaks free of the other two portions. The shear line 72*g* is located so that the portion inside member 74 breaks into two parts, thereby simplifying its removal from member 74. The portion of the members 72 remaining in each step tube is also easily removed preparatory to the molding of the next member to be cast. The intermediate portion falls free of the core member 76 and the cast member when it is removed from the mold assembly.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. An insert adapted to be embedded in a cast member for force-fittingly receiving a leg portion of a step, said insert being comprised of:

a hollow, substantially cylindrical-shaped elongated housing having an open end and a closed end;

one of the open end and the closed end having a flange lying entirely in a plane diagonally aligned with a longitudinal axis of said housing;

another one of the open end and the closed end having a flange lying in a plane perpendicular to said longitudinal axis;

an interior surface of said housing having a portion thereof being provided with a plurality of projections arranged at spaced intervals and extending radially inward;

each of the plurality of projections having a tapering cross-section defined by a first surface diagonally aligned with the longitudinal axis and facing the open end and a second surface perpendicular to said longitudinal axis and facing the closed end.

2. The insert of claim 1, further comprising a plurality of ears integrally joined at the open end of said housing and projecting away from the housing;

said ears being adapted to flex when a force is applied thereto;

each ear having a hooked-shaped configuration and cooperating with a flange adjacent said open end to embrace a marginal portion surrounding an opening in a support member for retaining the insert on the support member.

3. The insert of claim 2 wherein said flange at said open end covers said opening to prevent seepage therethrough.

4. The insert of claim 1 wherein said housing is provided with a second plurality of flanges extending radially outwardly from said housing and spaced along the housing for retaining the insert in place when embedded in a cast member.

5. The insert of claim 1 wherein said closed end has a flange extending radially outward therefrom to seal an opening in a mold core preparatory to insertion of the insert into a cast material.

6. The insert of claim 1 wherein a portion of said housing adjacent to said closed end and said closed end has a thickness which is chosen to provide additional structural strength to withstand forces encountered by said insert when injected into a cast material and also to regulate cycle time.

7. The insert of claim 1 wherein said diagonally aligned flange lies in a plane.

8. The insert of claim 2 wherein said flange at said closed end covers said opening to prevent seepage therethrough.

9. An insert assembly adapted to be embedded in a cast member for force-fittingly receiving a leg portion of a step, said insert assembly being comprised of:

first and second members adapted to be telescopingly mounted to one another;

said first member being a hollow, substantially cylindrical-shaped elongated housing having first and second open ends and an integral annular flange intermediate said first and second ends, said flange being diagonally aligned to a longitudinal axis of said first member;

said first member being slotted on opposite sides of said flange to enable said member to yield and flex when pressed inwardly;

said second member being a hollow, substantially cylindrical-shaped elongated housing having a first closed end and a second open end;

said open end of said second member being telescopingly mounted upon one end of said first member, whereby the second member forces the end of the first member inserted into the open end of said second member to flex inwardly, to provide a snug force-fit therebetween.

10. The insert assembly of claim 9 wherein said second member is provided with a plurality of outwardly extending integral flanges arranged at spaced intervals therealong to enhance embedment of the second member in a cast member.

11. The insert assembly of claim 9 wherein the closed end of said second member is provided with an annular flange lying in a plane diagonally aligned with a longitudinal axis of said second member.

12. The insert assembly of claim 9 wherein an interior surface of said second member has a portion thereof being provided with a plurality of annular projections extending radially inward; and each projection having tapering cross-section defined by a first surface diagonally aligned with and longitudinal axis and facing the open end and a second surface perpendicular to said closed end.

13. The insert assembly of claim 9 wherein said first member is provided with score areas adjacent one side of said diagonally-aligned flange to facilitate breaking away of the first member from said second member.

14. The insert assembly of claim 9 wherein said first member is provided with a plurality of outwardly directed annular flanges for gripping an interior surface of said second member, the surfaces of said flanges being inclined so that it requires less force to telescopingly mount the second member onto the first member than is required to pull the first and second members apart.

15. The insert assembly of claim 9 wherein said second member is provided with an inwardly directed helical annular flange for gripping an exterior surface of said first member, the surface of said helical flange being inclined so that it requires less force to telescopingly mount the second member onto the first member than is required to pull the first and second members apart, said helical annular flange also serving to form a snug press-fit with a leg of a step member insertable therein.

* * * * *